US005410340A

United States Patent [19]

Drake et al.

[11] Patent Number: 5,410,340

[45] Date of Patent: Apr. 25, 1995

[54] OFF CENTER HEATERS FOR THERMAL INK JET PRINTHEADS

[75] Inventors: Donald J. Drake, Rochester; Mark A. Cellura; Michael P. O'Horo, both of Fairport; Reinhold E. Drews, Pittsford, all of N.Y.

[73] Assignee: Xerox Corporation, Stamford, Conn.

[21] Appl. No.: 155,505

[22] Filed: Nov. 22, 1993

[51] Int. Cl.[6] ..... B41J 2/05

[52] U.S. Cl. ..... 347/62; 347/42

[58] Field of Search ..... 347/62, 56, 42, 40

[56] References Cited

U.S. PATENT DOCUMENTS

| | | | |
|---|---|---|---|
| Re. 32,572 | 1/1988 | Hawkins et al. | 156/626 |
| 4,463,359 | 7/1984 | Ayata et al. | 347/56 |
| 4,638,337 | 1/1987 | Torpey et al. | 347/65 |
| 4,678,529 | 7/1987 | Drake et al. | 156/234 |
| 4,774,530 | 9/1988 | Hawkins | 347/63 |
| 4,829,324 | 5/1989 | Drake et al. | 347/42 |
| 5,000,811 | 3/1991 | Campanelli | 156/264 |
| 5,010,355 | 4/1991 | Hawkins et al. | 347/64 |
| 5,160,403 | 11/1992 | Fisher et al. | 156/633 |

*Primary Examiner*—Joseph W. Hartary
*Attorney, Agent, or Firm*—Daniel J. Krieger

[57] ABSTRACT

An ink jet printhead having off center or offset heaters or thermal transducers to reduce heater damage. The printhead has heaters located beneath channels to eject ink from the channel through a nozzle to a substrate for printing. Edge heaters are spaced away from the dicing edges of the heater plate to avoid damage resulting from dicing for assembly or from thermal expansion due to adjacent printheads if used to form a page width or large array printhead. The spacing distance between the edge heaters to adjacent equally spaced heaters on the same printhead is less than the distance between adjacent equally spaced heaters. Edge heaters are also offset from the centerline of respective channels in the printhead.

15 Claims, 7 Drawing Sheets

OFF CENTER HEATERS FOR THERMAL INK JET PRINTHEADS

FIELD OF THE INVENTION

This invention relates generally to thermal ink jet printheads and more particularly to the placement of heater transducers on heater wafers and the alignment of heater transducers to ink channels in thermal ink jet printheads.

BACKGROUND OF THE INVENTION

Drop-on-demand thermal ink jet printers are generally well known, and in such systems, a thermal ink jet printhead comprises one or more ink filled chambers communicating with an ink supply chamber and an array of channels having open ends. A plurality of thermal transducers or heaters, usually resistors, are located beneath the channels at a predetermined location relative to the channels. The resistors are individually addressed with a current pulse thereby raising the temperature of the resistor and vaporizing the ink in contact with the resistor. A bubble is formed due to the heating of the ink. As the bubble grows, the ink bulges from the open end of the channel but is momentarily contained by the surface tension of the ink as a meniscus. As the bubble begins to collapse due to a drop in temperature of the resistor, the ink between the channel opening and the bubble starts to move towards the collapsing bubble, causing a volumetric contraction of the ink in the channel and resulting in the separation of the bulging ink as a droplet. The acceleration of the droplet out of the open end of the channel while the bubble is growing provides the momentum and velocity required for the droplet to travel in a substantially straight line direction towards a recording medium, such as paper.

A typical thermal ink jet printhead for use in an ink jet printer comprises an ink flow directing component, such as an etched silicon substrate which contains a linear array of channels open at one end and a common reservoir in communication with the channels, and a logic and thermal transducer component, such as a substrate which contains a linear array of heating elements, usually resistors, and monolithically integrated logic drivers and control circuitry. The components are aligned and mated with one resistor at each channel being located at a predetermined distance from the channel open end; the channel open ends serving as the droplet expelling channels or nozzles. Power MOS drivers immediately next to and integrated on the same substrate as the array of resistors are driven by the control circuitry, also integrated on the same substrate, that selectively enable the drivers which apply current pulses to the resistors.

One known method of fabricating thermal ink jet printheads is to form a plurality of the ink flow directing components and a plurality of logic, driver, and thermal transducer components on respective silicon wafers, and then aligning and bonding the wafers together, followed by a process for separating the wafers into a plurality of individual printheads, such as by dicing. The individual printheads are used in one common design of printer in which the printhead is moved periodically across a sheet of paper to form the printed image, much like a typewriter. Individual printheads can also be butted together side by side, placed on a supporting substrate, aligned, and permanently fixed in position to form a large array thermal ink jet printhead or a page width array printhead.

In U.S. Pat. No. 4,463,359 to Ayata et al., a drop on demand type ink jet recording method and apparatus which causes droplet emission from a small orifices is described. A drive signal is applied to the ink in a small liquid chamber to cause bubble formation in the ink which expels the ink from the orifice.

U.S. Pat. No. 4,638,337 to Torpey et al. describes an improved thermal ink jet printhead which prevents the sudden release of vaporized ink to the atmosphere, known as blowout, which causes ingestion of air and interrupts printhead operation.

U.S. Pat. No. 4,678,529 to Drake et al. describes a method of bonding thermal ink jet printhead components together by applying an adhesive to only higher surfaces of a substrate containing ink bearing structures, while all the surfaces of the ink bearing structures are free of adhesive.

U.S. Pat. No. Re. 32,572 to Hawkins et al. describes an ink jet printhead for high resolution printing made by concurrent fabrication of large quantities of printheads from two substrates that are preferably silicon wafers. A plurality of sets of bubble generating heating elements and their addressing electrodes are formed on one substrate and a corresponding plurality of sets of ink channels and their ink supplying manifolds are formed on another substrate.

U.S. Pat. No. 4,774,530 to Hawkins describes an ink jet printhead having electrode passivation and an elongated recess to provide an ink flow path between an ink manifold and individual ink channels by the placement of a thick film organic structure.

U.S. Pat. No. 4,829,324 to Drake et al. describes a large array thermal ink jet printhead and a fabrication process to provide precision assembly of the printhead using a subunit approach.

U.S. Pat. No. 5,000,811 to Campanelli et al. describes a fabrication approach for large array or page width thermal ink jet printheads in which wafer subunits are diced precisely for alignment and subsequent fabrication.

U.S. Pat. No. 5,010,355 to Hawkins et al. describes a two part thermal ink jet printhead in which one part contains ink flow directing channels, nozzles, and ink supplying reservoir, and the other part contains heating elements and ionic passivation of electronic driving circuitry.

U.S. Pat. No. 5,160,403 to Fisher et al. describes methods of fabricating ink jet printheads which can be butted against an aligning substrate to form an extended staggered array printhead.

SUMMARY OF THE INVENTION

In accordance with one aspect of the invention, there is provided a heater element having a linear array of thermal transducers spaced a substantially equal distance from one another and a first thermal transducer located at one end of the linear array of thermal transducers. The first thermal transducer is spaced from an adjacent one of the thermal transducers of the linear array a distance unequal to the distance between thermal transducers of the linear array. Means for driving the thermal transducers and logic means for controlling selective actuation of the thermal transducers through the driving means are also included.

Pursuant to another aspect of the invention, there is provided a printhead element having a channel element with a linear array of equally spaced nozzles and a heater element aligned and mated to the channel element. The heater element includes a linear array of thermal transducers spaced a substantially equal distance from one another and a first thermal transducer located at one end of the linear array of thermal transducers. The first thermal transducer is spaced from an adjacent one of the thermal transducers of the linear array a distance unequal to the distance between thermal transducers of the linear array. Means for driving the thermal transducers and logic means for controlling selective actuation of the thermal transducers through the driving means are also included.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention.

DETAILED DESCRIPTION OF THE INVENTION

Figure 1:
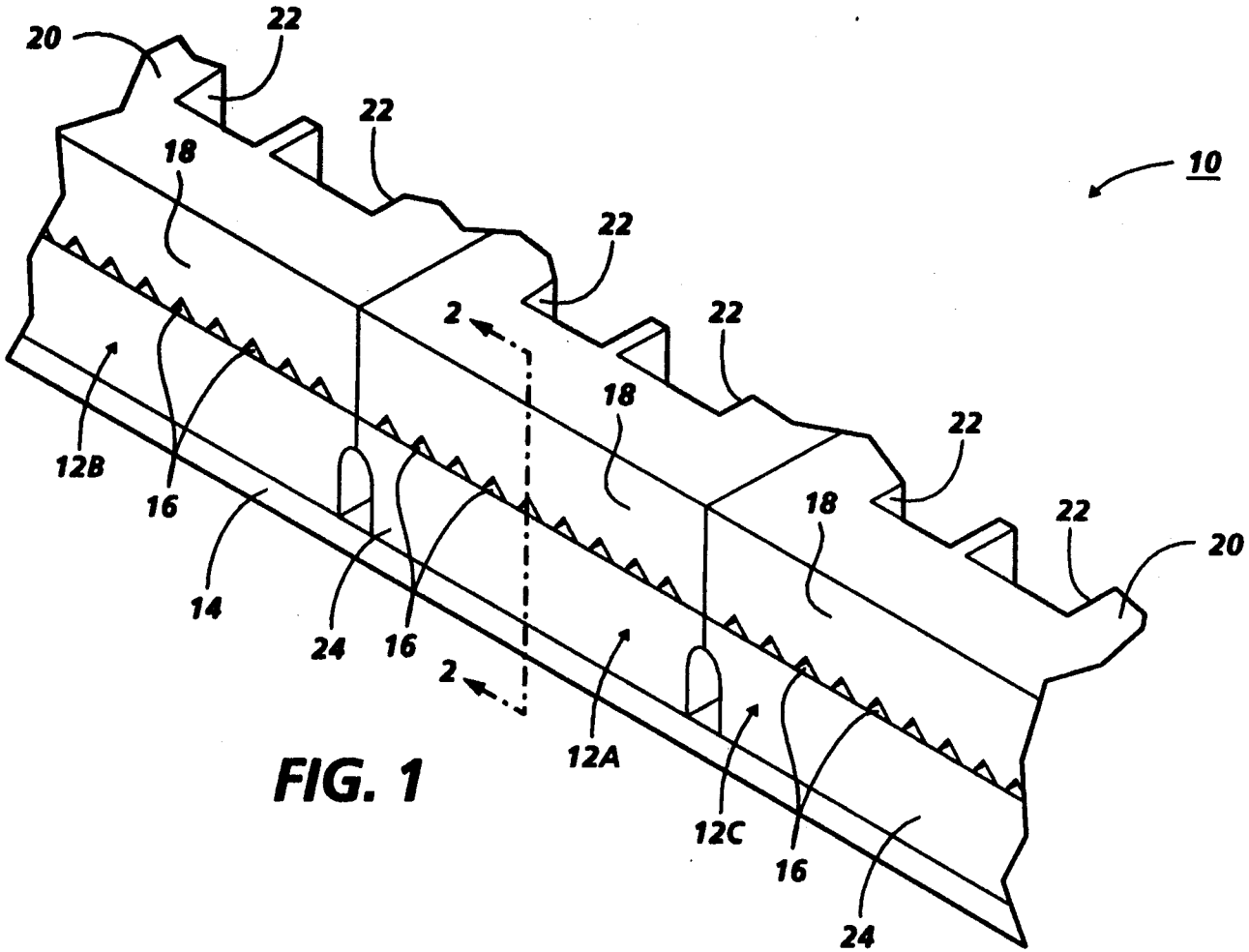
FIG. 1 is an enlarged, fragmentary perspective view of a printhead array.

FIG. 1 illustrates an enlarged schematic isometric partial view of a printhead array 10 comprised of a number of individual printhead elements 12. The individual printheads 12 are arranged in side by side relationship and supported by a supporting substrate 14. The supporting substrate 14 allows for the proper orientation of the individual printheads 12 and maintain proper alignment throughout the life of the printhead array 10. While FIG. 1 illustrates one full printhead 12A and two partially shown printheads 12B and 12C on opposite ends of the printhead array 10, a printhead array can be made of any number of individual printheads 12. For instance, a full page width printhead array printing across the short edge of a sheet of $8\frac{1}{2}\times 11''$ paper could consist of approximately 13 individual printheads 12 depending on the number of spots per inch. Likewise, if paper is being printed along the long edge of a sheet of $8\frac{1}{2}\times 11''$ paper, then a printhead array 10 might consist of 19 individual printheads 12.

The number of individual printheads 12 comprising the printhead array 10 not only depends on the length of the sheet of paper being printed upon but will also depend upon the number of channel openings or nozzles 16 in each of the individual printheads 12. In FIG. 1, the printheads are shown to have 10 nozzles per printhead. This number of nozzles 16 is shown for illustrative purposes only. Typically, an individual printhead 12 can have anywhere from 100 up to 300 or more individual nozzles 16.

The nozzles 16 are arranged in side by side relationship along a front face 18 of a channel element plate or upper substrate 20. The upper substrate 20 of each individual printhead 12 also includes a fill hole 22 which allows for ink to fill the channel openings 16 for later deposition upon a sheet of paper.

Located below each of the channel plates 20 is a lower electrical substrate or heating element plate 24. The heating element 24 includes electrical circuitry for causing ink to be expelled from each of the individual nozzles or channel openings 16. Any known method may be used to fabricate the individual printhead elements 12. Examples are U.S. Pat. No. Re. 32,572 to Hawkins et al., U.S. Pat. No. 4,774,530 to Hawkins and U.S. Pat. No. 5,000,811 to Campanelli, all incorporated herein by reference.

Figure 2:
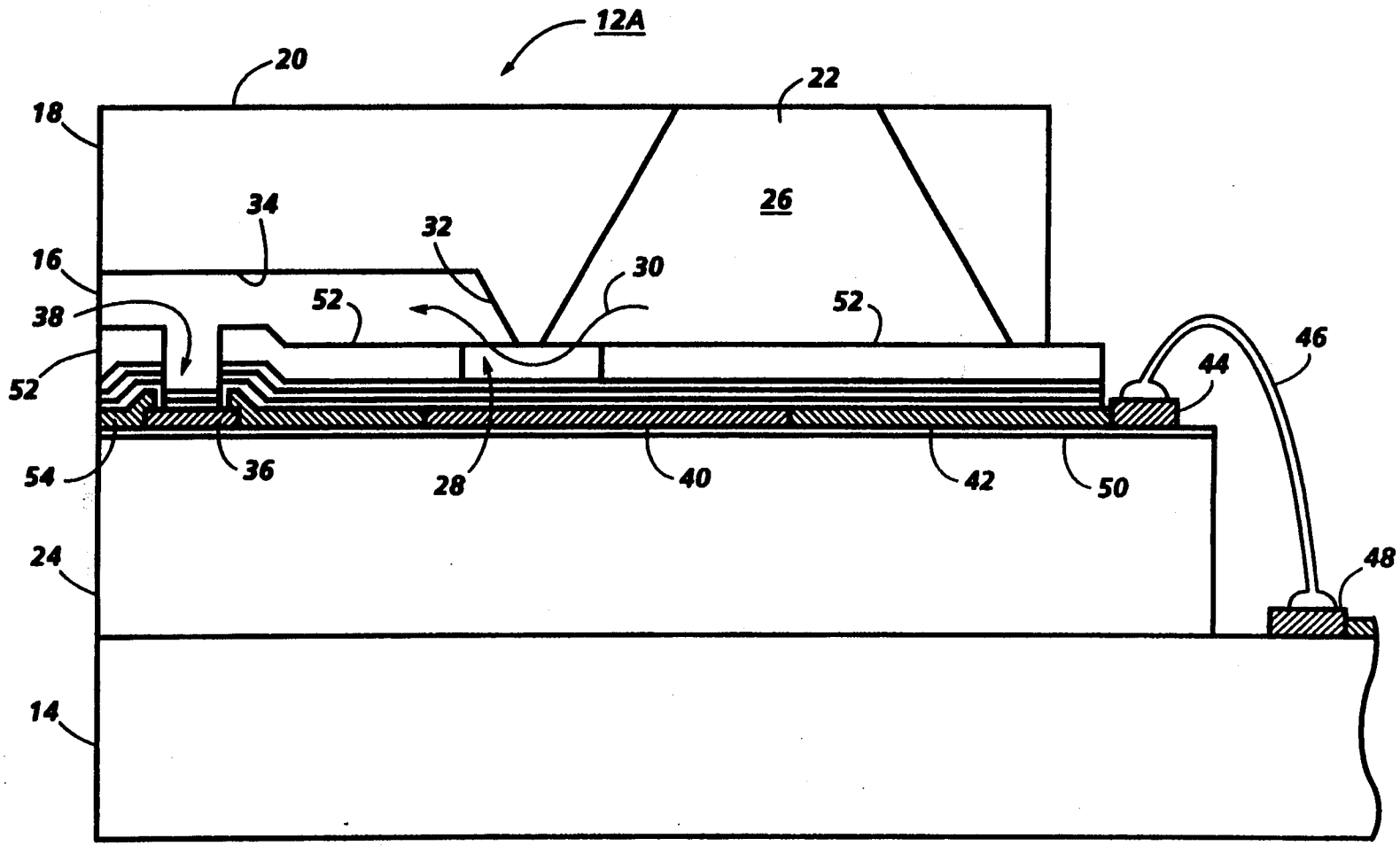
FIG. 2 is a sectional, elevational view of the printhead array of FIG. 1 taken along line 2—2 and viewed in the direction of the arrow.

A cross-sectional view of FIG. 1, taken along view line 2—2 through one of the nozzles 16, is illustrated in FIG. 2. FIG. 2 illustrates ink flow from the fill hole 22 out through the nozzles 16. Also shown is the related flow path and various circuitry necessary to cause the ink to be expelled from the nozzle 16. Ink enters the fill hole 22 and resides in a manifold 26 waiting for ejection upon paper by the printhead 12. The ink, which is ejected through the nozzles 16, travels from the manifold 26 and down through an elongated recess 28 as indicated by the arrow 30. Ink continues to pass from the elongated recess 28, passing a slanted wall 32, through a parallel groove or channel 34, and eventually out the nozzles 16. Ink fills the channel 34 through capillary action.

The surface of the channel plate 20 having the channels 34 is aligned and bonded to the heater plate 24 so that a respective one of a plurality of heaters or resistors 36 is located beneath a corresponding channel 34. As seen in the drawing, a pit 38 is included in the heating element plate 24 so that as ink flows through the previously described path some ink resides in the pit 38. It is through the action of the heater 36 being pulsed by a current pulse that a bubble is formed in the pit 38 which causes the ejection of ink from the nozzles 16 as previously described.

The heater plate 24 includes the electronic circuitry for driving each of the individual heater resistors 36. Each of the individual heaters 36 is driven by a portion of the electronic circuitry consisting of semiconductor drivers 40 which are, in turn, driven by logic circuitry 42. The logic circuitry 42, the drivers 40 and the heaters 36 are all formed on a silicon chip which has located thereon the circuitry made by typical large scale integrated circuit techniques as is known by those skilled in the art. The logic circuitry 42 is, in turn, connected to electrode terminals 44 which receive signals through wire bonds 46 connected to electrodes 48. The electrodes 48 are connected to control circuitry which is used to select which of the individual nozzles 16 expel ink. The logic circuitry and driving circuitry which is used to pulse the individual heaters 36 is shown in U.S.

patent application Ser. No. 07/971,873 assigned to the present assignee and herein completely incorporated by reference.

The heater plate 24 is formed on a silicon chip having a surface 50 upon which the heaters 36, the drivers 40 and the logic 42 is deposited. Above the circuitry is deposited a thick film insulating layer 52 such as Vacrel ®, Riston ®, Probimer ®, or polyimide. The thick film insulating layer 52 is a passivation layer sandwiched between the upper and lower substrates. MOS fabrication techniques are used for multilayer passivation of the logic circuitry and the drivers which will also protect the circuitry from mobile ions and ink similar to the methods disclosed in U.S. Pat. No. 5,010,355 to Hawkins, et al., the pertinent portions of which are herein incorporated by reference. The layer 52 is etched to expose the heaters 36 thus placing the heaters 36 beneath the pit 38. The elongated recess 28 is also etched on the thick film insulated layer 52 to enable the ink to flow between the manifold 26 to the channels 34. In addition, the thick film insulative layer is etched to expose the electrode terminals 44. Likewise, the thick film insulative layer 52 also covers a common or return path 54 which provides a return path for the circuitry.

It is also possible to control the heaters 36 by matrix addressing such as that described in U.S. Pat. No. 4,651,164 and U.S. Pat. No. 4,985,710. In addition, other forms of switchable addressing circuitry are possible and intended to be in the scope of the invention.

Figure 3A:
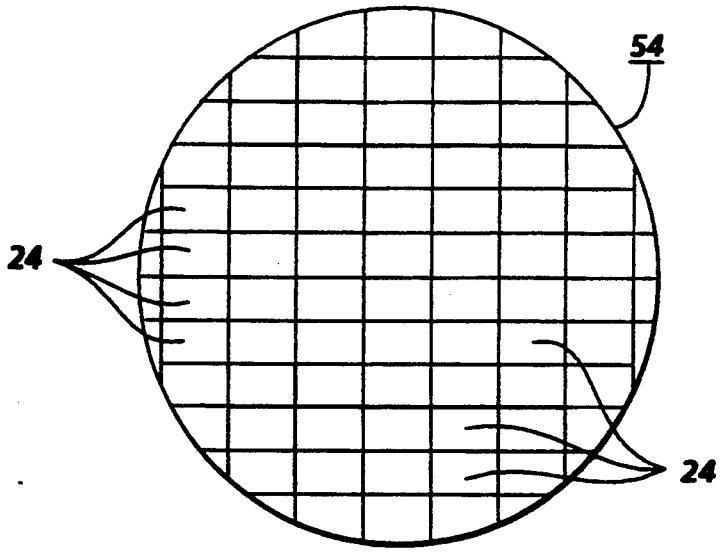
FIGS. 3A, 3B and 3C are schematic plan views of a wafer having a plurality of heating elements, with one heating element and one alignment mark being shown enlarged.
Figure 3B:
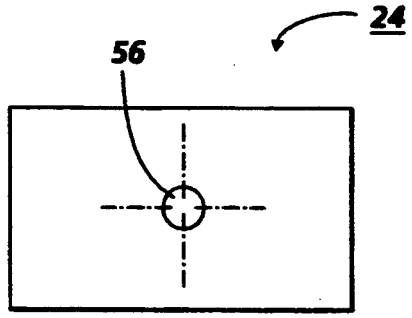
Figure 3C:
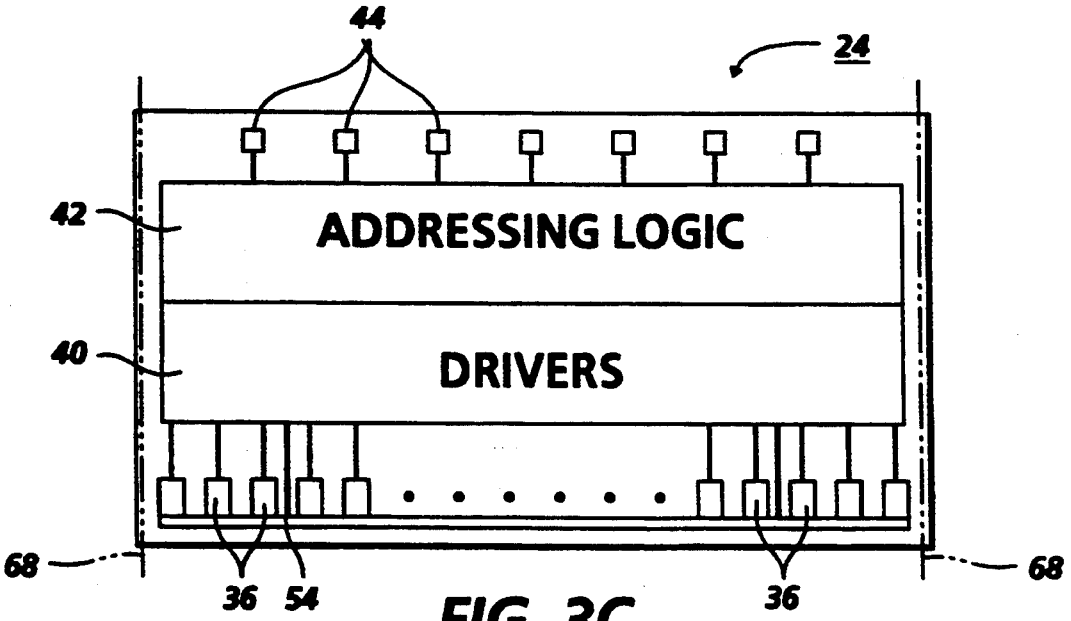

Each of the heating elements 24 is formed on a silicon wafer 54 as illustrated in FIG. 3A. The heaters 36, the drivers 40, the addressing logic 42 and the electrodes 44 are patterned on the polished surface of a single side polished (100) silicon wafer 54. The silicon wafer 54 can have up to 256 individual heating elements 24 or more depending on the diameter of the silicon wafer 54 being patterned. One of the heating elements 24 is enlarged and shown in FIG. 3C. As can be seen, FIG. 3C shows the respective location of the addressing logic 42, the drivers 44 and the heaters 36 on the heating element plate 24. The individual heaters 36 are patterned on the silicon substrate in side by side relationship so that each individual heater will be strategically associated with a corresponding channel when the heater wafer heating element 24 is mated to a channel element 20. An alignment mark 56 (see FIG. 3B) is placed on one of the heating element plates 24 to provide accurate alignment of the wafer 54 to a channel wafer 58 illustrated in FIG. 4A.

Figure 4A:
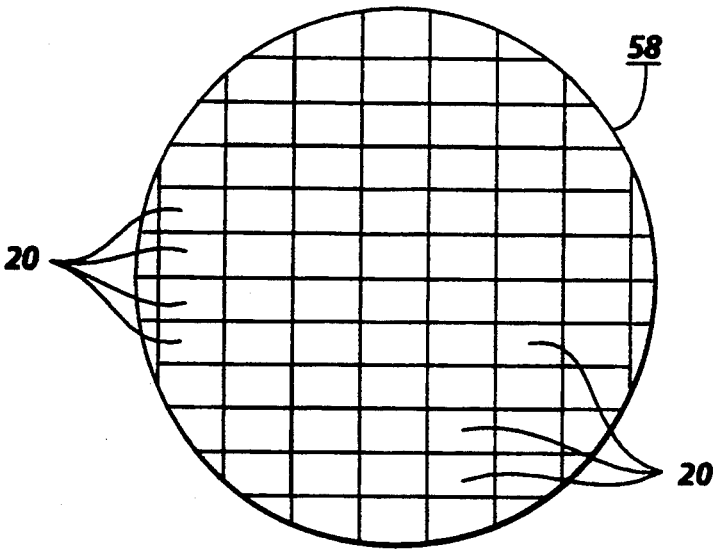
FIGS. 4A, 4B and 4C are schematic plan views of a wafer having a plurality of channel elements, with one channel element and one alignment opening being shown enlarged.
Figure 4B:
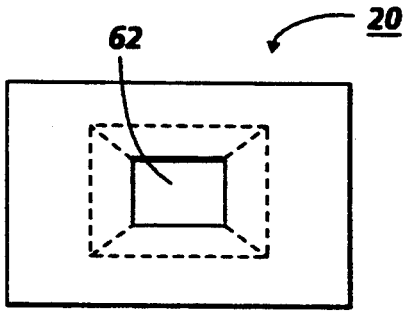

As illustrated in FIG. 4A, the channel wafer 58 includes a number of channel elements 20 which are layed on the surface of the silicon substrate 58. One of the individual channel elements 20 is shown in an enlarged view in FIG. 4C. The channel wafer 58 is a two sided polished (100) silicon wafer used to produce a plurality of channel elements 20 for individual or large array printheads. After the wafer is chemically cleaned, a silicon nitride layer, not shown, is deposited on both sides. Using conventional photolithography, the silicon nitride is plasma etched off of the alignment opening 62 shown in FIG. 4B.

The wafer 58 is photolithographically patterned using the previously plasma etched alignment holes 62 as a reference to form the channel grooves 34, and one or more fill holes 26. A potassium hydroxide (KOH) anisotropic edge is used to etch the alignment hole 62, channels 34, and fill holes 26. In this case, the {111} planes of the (100) wafer make an angle of 54.7 ° with the surface of the wafer.

Figure 4C:
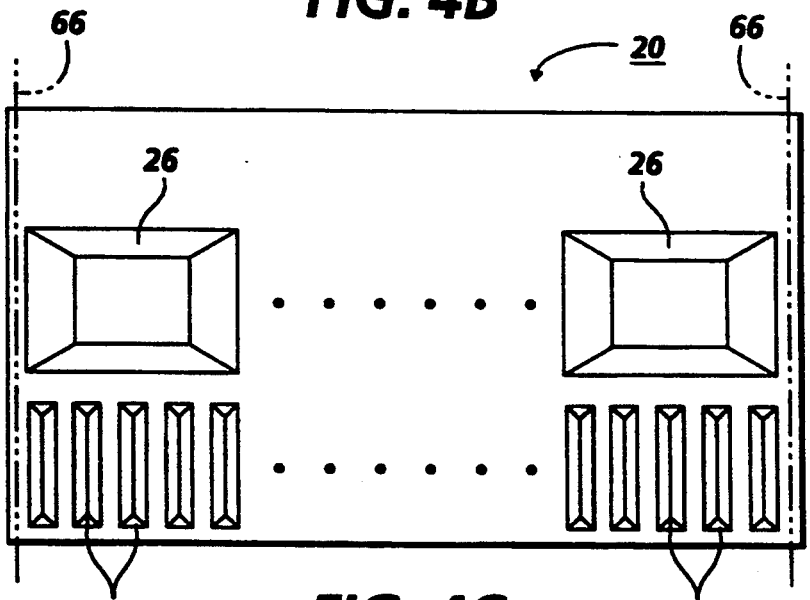

Because each of the individual heating element plates 24 are patterned on a large silicon wafer 54, each individual heating element 24 must be separated from its adjoining heating element 24 on the silicon wafer. The separation of individual heating element 24 from the silicon wafer can be accomplished by any number of known dicing operations made along parallel dicing cuts 68 (see FIG. 3C). However, the dicing operations used to separate one heating element plate 24 from another, involves some risk of damage to individual heating elements 24, and in particular, the heaters 36, due to the small amount of area between adjacent heating elements 24. This fabricating process also requires that parallel milling or dicing cuts 66 be made which are parallel to the channel grooves 34 of the channel element 20 as shown in FIG. 4C.

The diced cuts made at the edges of the heater plate 24 are parallel to the heaters 36. Once the individual heater wafers 54 and channel wafers 58 have dicing cuts made along the wafer, the channel wafer 58 has an adhesive applied thereto, is aligned and mated it the heater wafer 54 by a number of techniques including that described in U.S. Pat. No. 4,678,529 to Drake et al. assigned to Xerox Corporation, herein incorporated by reference.

Figure 5A:
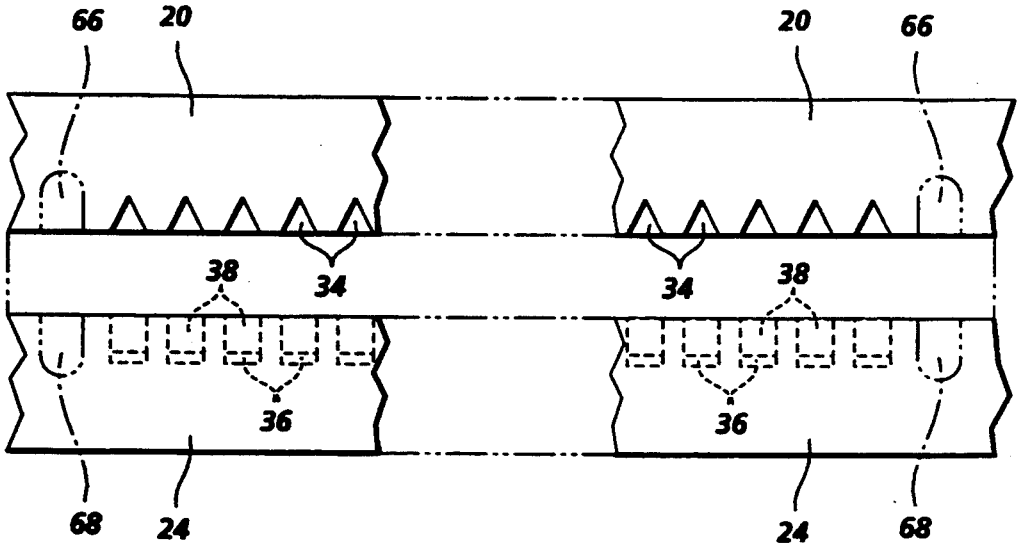
FIG. 5A PRIOR ART
FIGS. 5A and 5B are schematic, elevational views of the front faces of a channel element and heater element before and after mating showing dicing cuts and back cuts.
Figure 5B:
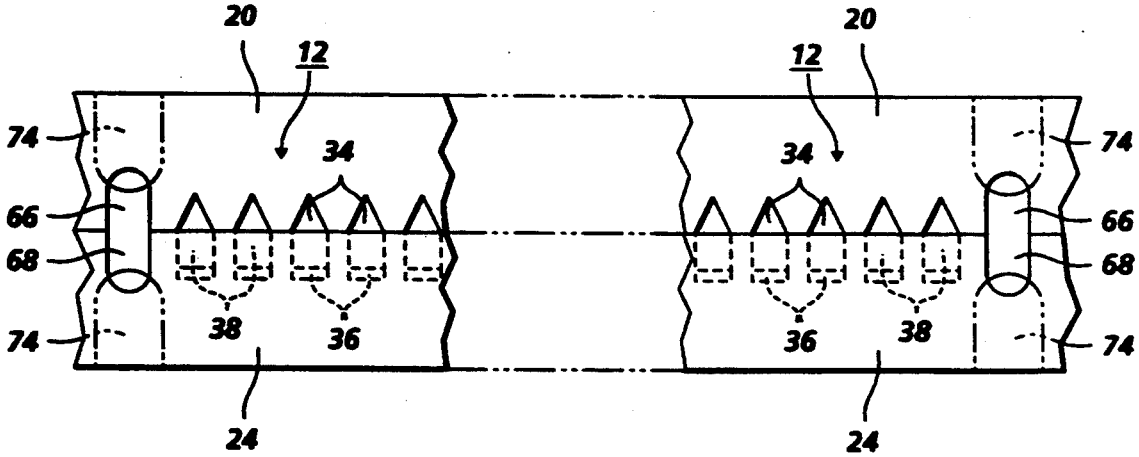
FIG. 5B PRIOR ART

FIG. 5A illustrates the heater wafer 54 and the channel wafer 58 each having respective dicing cuts 68 and 66 which have been made to the mating surfaces of each of the wafers. The heaters 36 are shown centered with respect to corresponding channels 34. FIG. 5B illustrates the next step in the process in which individual printheads are manufactured by placing back cuts 74 which essentially are back cut into the dicing cuts 66 and 68 so that individual printheads 12 can be separated from the entire two-wafer structure consisting of the channel wafer 58 and the heater wafer 54.

Because individual printhead elements 12 are cut and then placed in a large fixture to create an array of printheads, the spacing between the nozzles of one printhead 12 to an adjacent printhead 12 must be consistent throughout the entire array. Consequently, to make a proper spacing of nozzles throughout the array the back cuts 74 are necessarily cut close to the individual heater elements 36 located at the edges of the individual printheads 12. While physically butting together individual thermal ink jet printheads is a good approach for creating an array of printhead elements 12, it does require that the printhead elements 12 be diced at the midline between individual heaters 36. For a 300 spot per inch design, the heaters are spaced center to center 85 microns apart when using a 55 micron wide heater. Such a spacing requires that a dicing distance is no greater than 15 microns from the edge of the individual heaters 36 which are located at opposite ends of the die. In practice, the cut must be made even closer to insure that the pitch spacing is not exceeded between end heaters of adjacent heater elements 24. The closer the placement of the dice cut relative to the heater the higher the probability of dicing saw damage to the heater.

In addition, it is common practice to undercut the precision diced edge to minimize the effect of dirt and any dicing saw non-perpendicularity on the butted die placement. This, however, can make the butting edge and the polyimide layer fragile and susceptible to dicing damage from butted thermal expansion compression. Consequently, the heaters located at the edges of the individual heater elements 24 have more risk to damage and early failure than those which are located in the interior of the individual printhead 12. The present invention therefore is a method and an apparatus minimizing end heater susceptibility to damage by, in one case, moving the end heaters away from the dicing cuts. This concept is enabled by the observation that within a reasonable range the placement of the heater 36 and of the pit 38 relative to the ink channel 34 do not significantly affect drop directionality. Consequently, a heater plate design in which end heaters or groups of end heaters are positioned in board of a normally centered position relative to the ink channels is desirable. Such a design makes heater 36 located next to dicing cuts less susceptible to damage from dicing or back cuts but does not impose a penalty of misdirectionality of the firing of the individual ink jet nozzles. Thus, the off axis alignment of the end heaters with respect to the channels provides a more robust buttable printhead but will not show significant drop in ink directionality. In addition, moving end heaters inward on single element printheads such as those in printers, a printhead moved across the paper is also desirable.

Figure 6A:
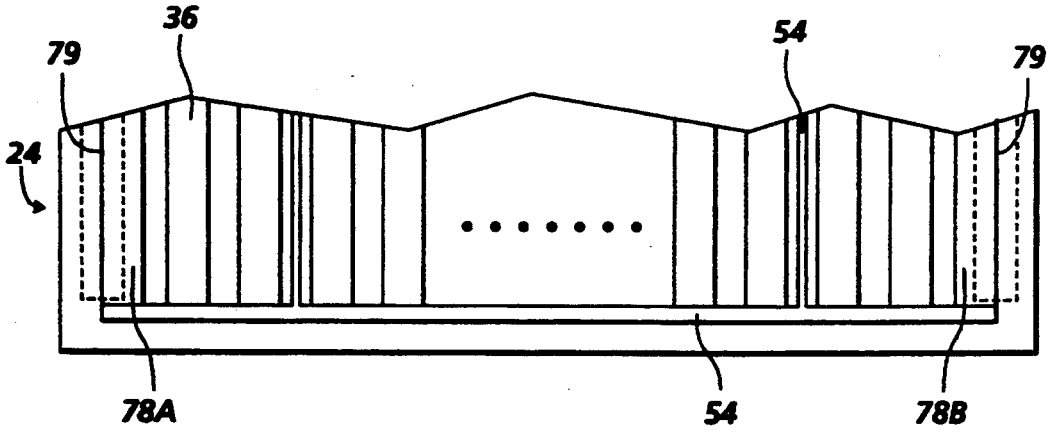
FIGS. 6A and 6B are schematic, fragmentary, plan views of a heater element having offset heaters in accordance with the present invention.
Figure 6B:
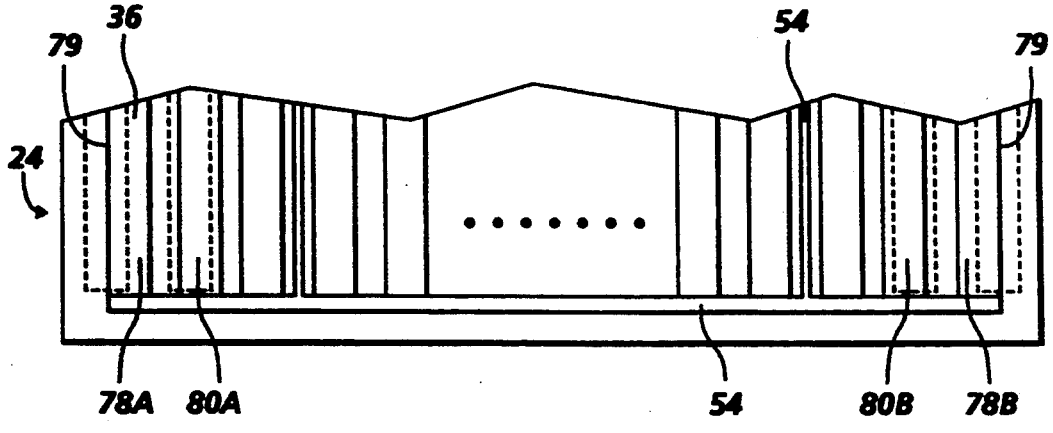

FIGS. 6A and 68 illustrate two different embodiments of the present invention. FIG. 6A illustrates a portion of the heater plate 24 showing the location and spacing of the heaters 36. The end heaters 78A and 78B have been moved inward from the previous locations here shown in dotted outline. The end heaters 78A and 78B have been moved half the distance of the distance previously between the heaters 36 as they are shown in the FIGS. 5A and 5B. This distance would place an outer edge 79 of the edge heater 78 approximately 15 microns from the previous location.

In FIG. 68, a second embodiment of the present invention is shown. End heaters 78A and 78B have been moved inward and the heaters 80A and 80B, heaters adjacent to the end heaters 78A and 78B, have been moved inward also. In this instance, a quarter of the distance of the distance previously maintained between each of the individual heaters 80A and 80B. By moving more than one heater inward from the edge of the heater plate 24, the distance between the edge heater 78 and the adjacent heater 80 can be made greater than if only the edge heater 78 is moved inward, thereby reducing of eliminating any effects heater spacing may have on the operation of adjacent heaters. It is, of course, possible to move more than two heaters inward from each end of the heater plate 24.

Figure 7A:
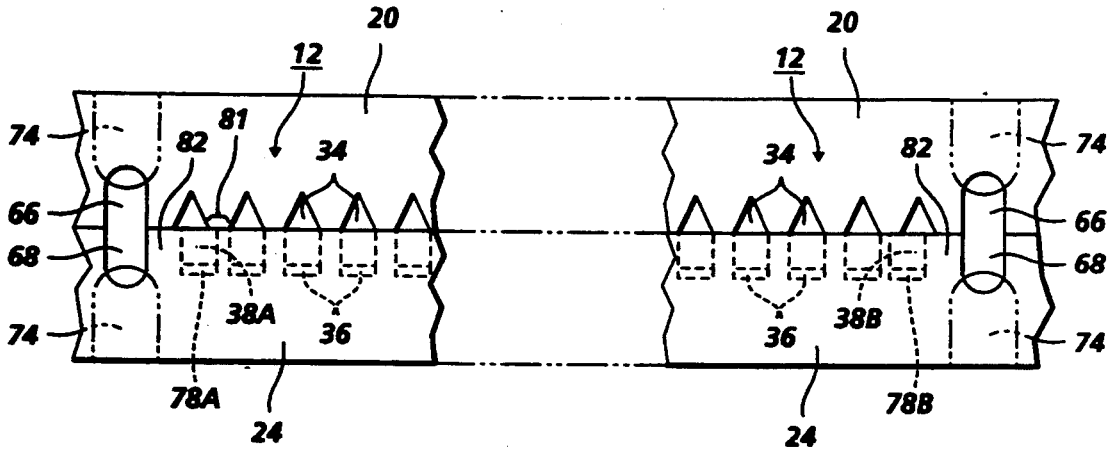
FIGS. 7A and 7B are schematic, elevational views of the front face of a printhead having offset heaters in accordance with the present invention.
Figure 7B:
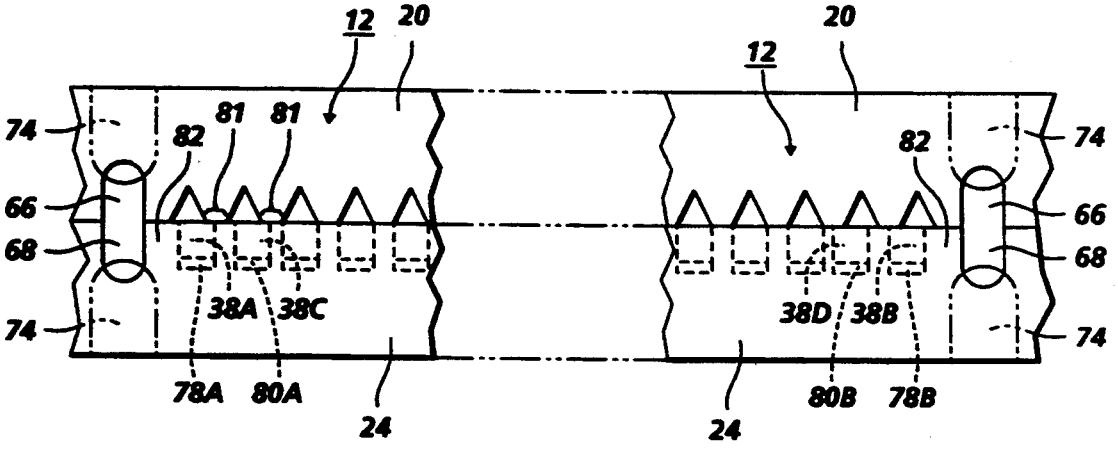

FIG. 7A illustrates mated channel element 20 and heater element 24 showing the respective locations at channels 34 to heaters 36. Heaters 36 and pits 38 are shown in outline to indicate being recessed from the front face of the printhead element 12.

As illustrated in FIG. 7A, the pits 38A and 38B associated respectively with edge heaters 78A and 788 are moved inward so as to be located above the heaters. Moving the heaters and pits inward places the heaters and pits beneath a flat portion or area 81 of the channel element thereby covering a portion of the heaters and pits. It has been found that moving the heater and pit beneath the flat portion 81 does not significantly affect printing.

Likewise, in FIG. 78, the pits 38C and 38D associated, respectively, with heaters 80A and 80B are moved inward from the edge. By moving the pits 38A and 388 inward, a polyimide wall 82 at the edges of the heater element 24 becomes wider and therefore less likely to suffer damage during dicing and back cuts because the thicker the wall 82 is, the less fragile the wall 82 becomes.

In recapitulation, an apparatus and method for preventing damage to heaters in a printhead or printhead array is described. It is, therefore, apparent that there has been provided in accordance with the present invention, a printhead element less susceptible to end heater damage and polyimide wall damage due to dicing or cutting or thermal expansion in large array printheads.

While this invention has been described in conjunction with a specific embodiment thereof, it is evident that many alternatives, modifications, and variations will be apparent to those skilled in the art. For instance, it is possible to move only the heaters inward without moving the associated pits, to maintain the location of a pit directly beneath a channel. Accordingly, it is intended to embrace all such alternatives, modifications and variations including staggered spacing of heaters that fall within the spirit and broad scope of the appended claims.

We claim:

1. A heater element, comprising:

a linear array of thermal transducers with said thermal transducers being spaced from one another a substantially equal distance; and a first thermal transducer located at one end of said linear array of thermal transducers, said first thermal transducer being spaced from an adjacent one of said thermal transducers of said linear array a distance unequal to the distance spacing said thermal transducers of said linear array from one another.

2. The heater element of claim 1, further comprising: means for driving said linear array of thermal transducers and said first thermal transducer.

3. The heater element of claim 1, further comprising a second thermal transducer located at the other end of said linear array of thermal transducers, said second thermal transducer being spaced from an adjacent one of said thermal transducers of said linear array a distance unequal to the distance spacing said thermal transducers of said linear array from one another.

4. The heater element of claim 3, wherein the distance between said first thermal transducer and an adjacent one of said linear array of thermal transducers is less than the distance between adjacent thermal transducers of said linear array.

5. The heater element of claim 4, wherein the distance between said second thermal transducer and an adjacent one of said linear array of thermal transducers is less than the distance between adjacent thermal transducers of said linear array.

6. The heater element of claim 4, wherein the distance between said first thermal transducer and said adjacent one of said linear array of thermal transducers is greater than one-half the distance between adjacent thermal transducers of said linear array.

7. The heater element of claim 6, wherein the distance between said second thermal transducer and said adjacent one of said linear array of thermal transducers is greater than one-half the distance between adjacent thermal transducers.

8. The heater element of claim 7, wherein the distance between adjacent thermal transducers of said linear array is approximately 15 microns.

9. A printhead element, comprising:

a channel element including a linear array of equally spaced nozzles;

a heater element aligned with and mated to said channel element, said heater element including a linear array of thermal transducers with said thermal transducers being spaced from one another a substantially equal distance, a first thermal transducer located at one end of said linear array of thermal transducers, said first thermal transducer being spaced from an adjacent one of said thermal transducers of said linear array a distance unequal to the distance spacing said thermal transducers of said linear array from one another; and means for driving said linear array of thermal transducers and said first thermal transducer.

10. The printhead element of claim 9, further comprising a second thermal transducer located at the other end of said linear array of thermal transducers, said second thermal transducer being spaced from an adjacent one of said thermal transducers of said linear array a distance unequal to the distance spacing said thermal transducers of said linear array from one another.

11. The printhead element of claim 10, wherein the distance between said first thermal transducer and an adjacent one of said linear array of thermal transducers is less than the distance between adjacent thermal transducers of said linear array.

12. The printhead element of claim 11, wherein the distance between said second thermal transducer and an adjacent one of said linear array of thermal transducers is less than the distance between adjacent thermal transducers of said linear array.

13. The printhead element of claim 11, wherein the distance between said first thermal transducer and said adjacent one of said linear array of thermal transducers is greater than one-half the distance between adjacent thermal transducers of said linear array.

14. The printhead element of claim 13, wherein the distance between said second thermal transducer and said adjacent one of said linear array of thermal transducers is greater than one-half the distance between adjacent thermal transducers.

15. The printhead element of claim 14, wherein the distance between adjacent thermal transducers of said linear array is approximately 15 microns.

* * * * *